US007150428B2

(12) United States Patent
Dubois et al.

(10) Patent No.: US 7,150,428 B2
(45) Date of Patent: Dec. 19, 2006

(54) BEAM LASER ATMOSPHERIC SCATTERING TRAJECTORY GUIDANCE

(75) Inventors: Jacques Dubois, Neufchatel (CA); Jean Fortin, St-Nicolas (CA)

(73) Assignee: Her Majesty the Queen in right of Canada, as represented by the Minister of National Defence, Ottawa (CA)

( * ) Notice: Subject to any disclaimer, the term of this patent is extended or adjusted under 35 U.S.C. 154(b) by 0 days.

(21) Appl. No.: 10/933,527

(22) Filed: Sep. 3, 2004

(65) Prior Publication Data

US 2006/0049299 A1 Mar. 9, 2006

(51) Int. Cl.
*F41G 7/26* (2006.01)
*F41G 7/24* (2006.01)
*F41G 7/00* (2006.01)

(52) U.S. Cl. ..... 244/3.13; 244/3.1; 244/3.11

(58) Field of Classification Search ..... 244/3.1–3.3
See application file for complete search history.

(56) References Cited

U.S. PATENT DOCUMENTS 3,614,025 A * 10/1971 Maillet ..... 244/3.13
4,234,141 A 11/1980 Miller, Jr. et al.
H299 H 7/1987 Miller, Jr.
4,696,441 A * 9/1987 Jones et al. ..... 244/3.13
5,374,009 A * 12/1994 Miller et al. ..... 244/3.13
5,878,977 A * 3/1999 Hosaka et al. ..... 244/3.13
6,138,944 A 10/2000 McCowan et al.
6,568,627 B1 * 5/2003 Jones et al. ..... 244/3.13

* cited by examiner

*Primary Examiner*—Bernarr E. Gregory
(74) *Attorney, Agent, or Firm*—Stites & Harbison PLLC; Ross F. Hunt, Jr.

(57) ABSTRACT

A guidance system for a missile utilitizes a laser beam source at a missile launch pad to generate a laser beam that is directed towards a target. A sensor on the body of a spinning missile detects radiation scattered from the laser beam, the sensor looking sideways and backward at an angle to the missile's longitudinal axis. Signals generated by that sensor are applied to a missile's guidance system's processing electronics that then determines the distance from the missile to the beam from the width of the signal generated by the sensor due to detecting scattered radiation from that laser beam. Once the distance between the missile and the beam is determined, the missile's guidance system corrects the missile's trajectory to maintain its position at a predetermined distance from the beam.

25 Claims, 5 Drawing Sheets

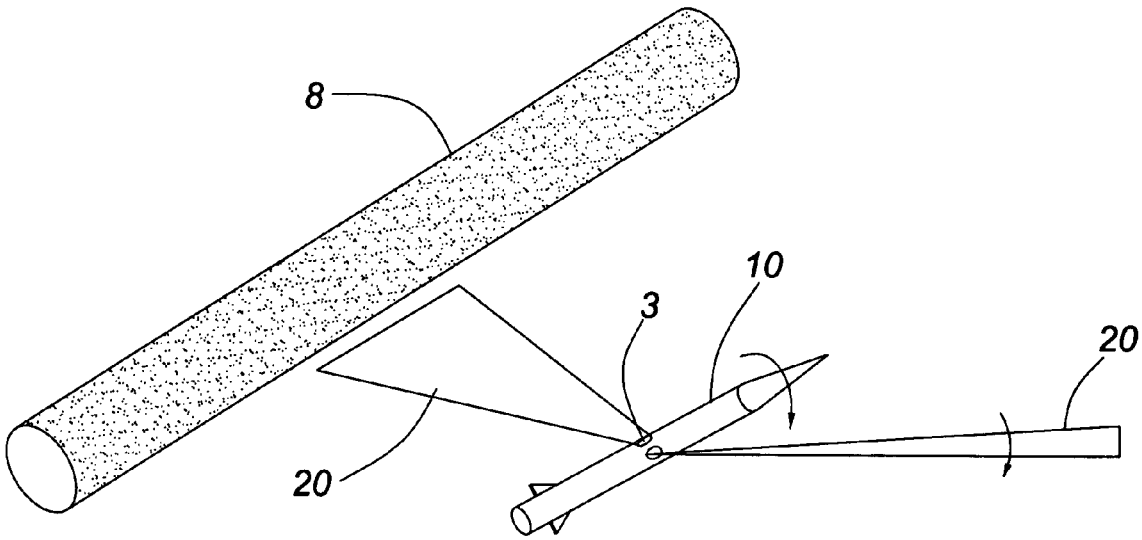
FIG. 2A
FIG. 2B
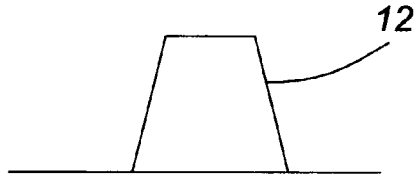
FIG. 2C
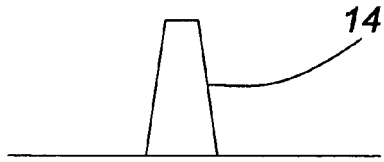

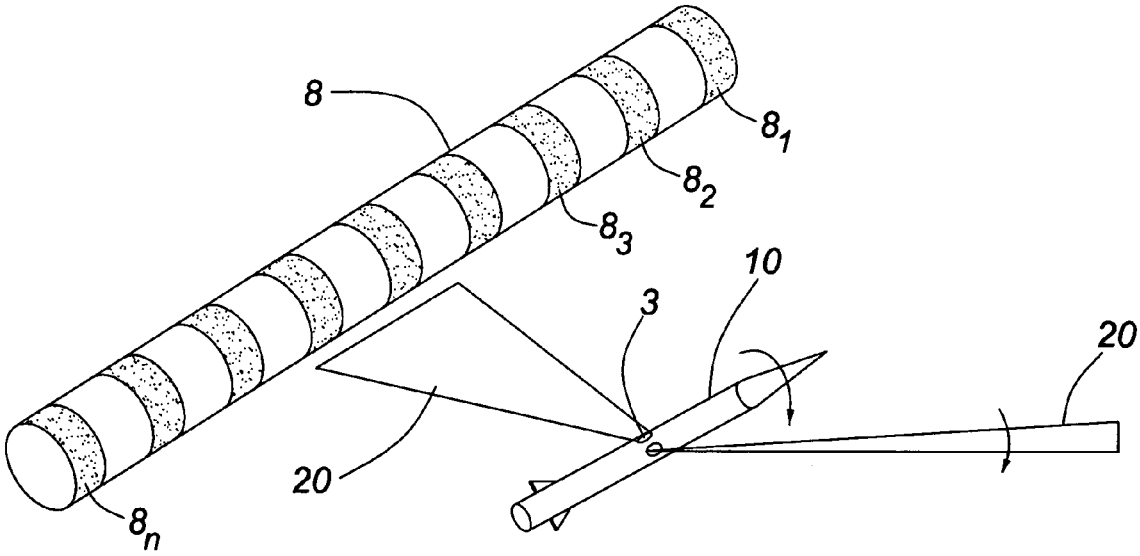
FIG. 3A
FIG. 3B
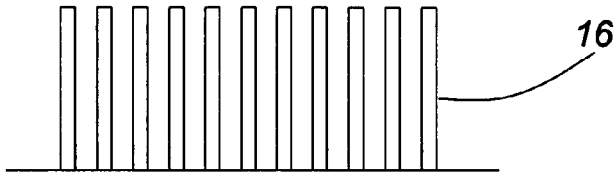
FIG. 3C
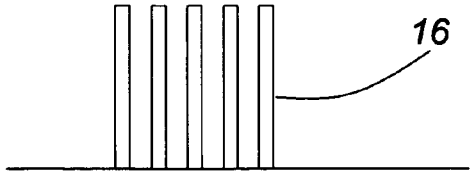

BEAM LASER ATMOSPHERIC SCATTERING TRAJECTORY GUIDANCE

FIELD OF THE INVENTION

The present invention relates to a missile guidance system and in, particular, to a system where sensors on the missile detect light scattered from a laser beam directed towards a target, signals generated by the sensors being applied to processing electronics in the missile that determines, from the signals, the distance the missile is from the beam and then provides guidance signals to the missile's guidance system to maintain the missile's trajectory at a predetermined position with respect to the laser beam.

BACKGROUND OF THE INVENTION

Precision guidance for missiles is a subject of high interest for all military organizations throughout the world. The required precision has high costs due, in great part, to the complexity of the guidance techniques generally used. Radar, RF, GPS, TV, IR or lasers are examples of technologies that have been used to meet the guidance precision requirements. The majority of the present approaches are based on terminal homing seekers. The problem with these approaches is the high costs associated with seeker components such as gimbals, domes, high performance electronics and software. Other techniques make use of a human in the loop to reduce the complexity and costs of the components installed aboard a missile. In these techniques, a human operator provides assistance to a missile's guidance system by correcting its trajectory through a data link such that a satisfactory trajectory of the missile to the target is achieved. This approach substantially reduces the costs of the guidance system but the precision is directly proportional to the operator's skill and this can be highly variable.

One technique using an operator to guide missiles during flight is described in U.S. Pat. No. 4,234,141 by Walter E. Miller Jr., which issued on 18 Nov. 1980. In this guidance system, an observer establishes and maintains a visual line-of-sight contact with a target through a telescope. In tracking the missile's trajectory towards the target, short pulses of collimated light are transmitted from the launch site towards the missile, which pulses are received by an optical receiver on the missile and are simultaneously reflected by a retro reflective prism on the missile. The reflected pulses follow a path parallel to the incident wave and are thus directed back to the launch site. A missile tracker at the launch site responds to the reflected pulses and measures any deviation of the missile from the visual line-of-sight maintained between the launch site and the target. Guidance commands are then transmitted towards the missile for maintaining the missile on a proper trajectory, which pulses contain correctional signals for the missile's guidance system. The guidance precision of this technique is proportional to the observer's (operator's) skill in maintaining the visual line-of-sight contact with the target and this can be rather variable.

Another missile guidance system is a scatterider guidance system that utilizes a designating beam of laser pulses directed from the launch pad towards a target. Atmospheric particles scatter the laser pulses and sensors on the missile detect the laser light scattered by the atmospheric particles and onboard guidance electronics calculate the radial distance between the laser beam and the longitudinal axis of the missile. That distance is then used to generate deflection commands for the aerodynamic control surfaces of the missile such that it stays close to the laser beam. In the embodiment described by McCowan et al in U.S. Pat. No. 6,138,944, laser light scattered from atmospheric particles for one laser pulse is detected by eight aft-looking optical sensors mounted around the circumference of the missile and one annular forward-looking sensor mounted on the nose section. The aft-looking sensors are mounted with their centrelines angled such that they point 60 degrees aft of the perpendicular to the missiles' longitudinal axis and each has a field-of-view of 45 degrees so the eight sensors provide a 360 degree coverage around the missile. The detection of back-scatter laser light is provided by one annular forward-looking sensor that is mounted such that it stares at a 45 degree angle forward of the perpendicular to the missile's longitudinal axis.

In U.S. Pat. No. 6,138,944, when light scattered from a single laser pulse is detected by one of the eight aft-looking sensor and by the forward-looking sensor, this detection as well as the time lapse between the detection by the aft-looking sensor and detection by the forward-looking sensor are provided as inputs to guidance electronics. That time lapse will be directly dependent on the radial distance between the missile's longitudinal axis and the laser beam due to the time it takes the laser pulse to travel from the aft-looking detection point and the forward-looking detection point. The guidance electronics is coupled to the aft-looking sensors to derive which one actually detected the scattered light and then calculates the radial distance between the laser beam and the missile using principles of geometry and trigonometry. That distance as well as the aft-looking detector that detected the scattered laser light is used to generate commands for the guidance system to maintain the missile on the desired trajectory with respect to the laser beam. The precision of this guidance system is dependent on the precision of the geometric and trigonometry calculations. The annular forward-looking sensor will limit what type of countermeasure may be effective since no sensor is looking directly at the target. It does, however, require inertial rate sensors and a roll sensor.

Another laser guidance system for a missile is described in JP Patent No. 2000039296 (Application No. JP 98209942) based on three laser beams directed along vertices of an equilateral triangle between which a missile flies and determines its position by the relative level of scattered laser light detected by a number of sensors on the missile.

A further laser guidance system for a missile is described by Walter E. Miller Jr., in US Statutory Invention Registration H299 that was published on 7 Jul. 1987. In this system the operator maintains sight of a target through optics at a fire control station. A laser transmitter on the missile directs a laser beam towards the fire control station where it is received and coupled to a phase conjugated amplifier and redirected back through a spatial encoder to the missile. The encoding provides guidance instructions for the missile where the redirected beam is received and applied to the missile's guidance control system. This guidance system does not have any sensor directed toward the target and this limits what type of countermeasures may be effective. It does, however, require an operator in the loop that has to maintain visual sight of the target.

The majority of guidance techniques, other than those taught by McCowan et al and Walter E. Miller Jr., share a common weakness in that they are susceptible to detection by the target which can employ countermeasure since the field-of-view of their guidance sensor have to continuously look at the target. Countermeasure that may be employed including dazzling or destruction of the sensor which would ruin the precision guidance of the missile. The majority of these missiles still rely on complex and costly gyroscopes and accelerometers to assist in guidance.

A new generation of hypervelocity missiles presently being developed inevitably call for a highly profiled fuselage nose that denies any possibility of using a forward-looking sensor because that would require a dome at the tip of the missile. There is, as a result, a requirement for a new guidance system for missiles that would be almost immune to known countermeasures while permitting use of a highly profiled nose and provide for a low cost implementation.

SUMMARY OF THE INVENTION

It is an object of the present invention to provide a guidance system for a vehicle that is less costly to implement.

A guidance system for a vehicle, according to one embodiment of the present invention, comprises a laser beam source directing at least one laser beam towards a required designated final location for the vehicle on which at least one sensor is located, that sensor rotating around an axis in the direction of travel of the vehicle and having a field-of-view (FOV) that is generally directed sideways to the direction of travel of the vehicle, the sensor generating a signal in response to detecting radiation from the laser beam scattered by an atmosphere through which the laser beam propagates, the width of said signal being proportional to the distance between the beam and said vehicle, signals from said at least one sensor being applied to a vehicle guidance system in the vehicle that determines the distance from the vehicle to the beam and then provides correction commands to the guidance system to correct the direction of travel of the vehicle.

BRIEF DESCRIPTION OF THE DRAWINGS

Preferred embodiments of the invention will now be described in more detail with reference to the accompanying drawing, in which:

FIG. 2A illustrates the operation of a laser beam guidance system for a spinning missile according to one embodiment of the present invention, FIG. 2B showing the type of signal obtained by a sensor in FIG. 2A when a laser beam is near the missile whereas FIG. 2C shows the type of signal obtained by that sensor when the laser beam is at a greater distance from the missile;

FIG. 3A illustrates the operation of a laser beam guidance system for a spinning missile according to another embodiment of the present invention where the laser beam is pulsed, FIG. 3B showing the type of signal obtained by a sensor in FIG. 3A when a pulsed laser beam is near the missile whereas FIG. 3C shows the type of signal obtained by that sensor when the pulsed laser beam is at a greater distance from the missile;

BRIEF DESCRIPTION OF THE PREFERRED EMBODIMENTS

Figure 1:
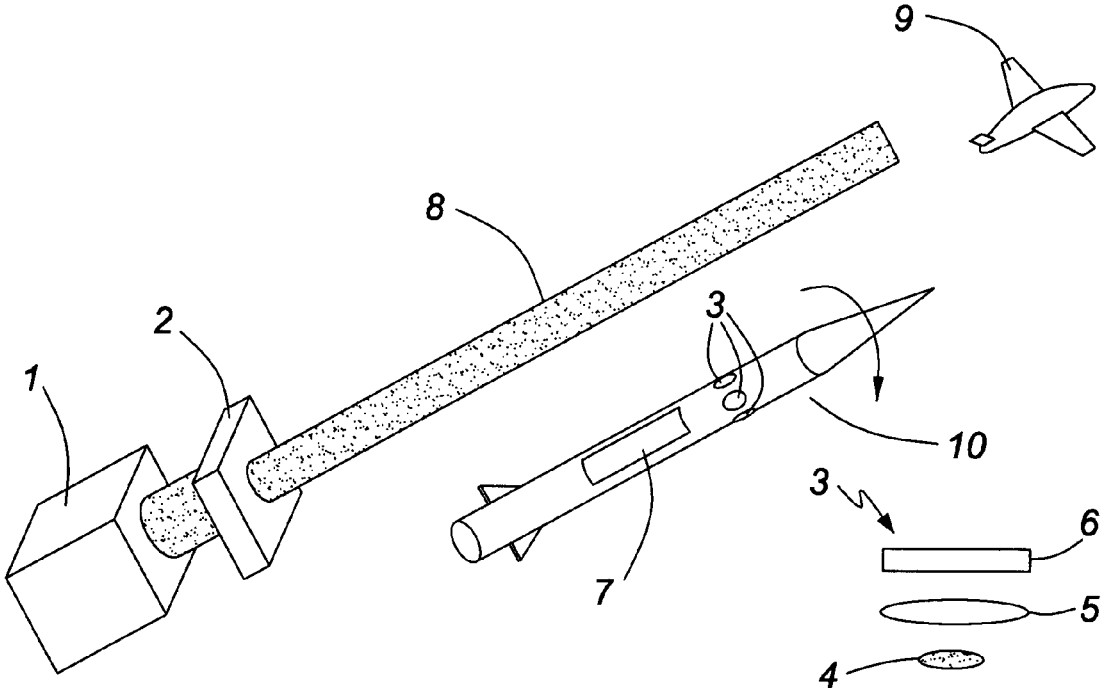
FIG. 1 illustrated a laser beam guidance system for a missile according to a basic arrangement of the present invention.

Precision guidance for missiles is a subject of high interest for all military organizations throughout the world. The required precision has high costs due, in great part, to the complexity of the guidance techniques generally used. Radar, RF, GPS, TV, IR or lasers are examples of technologies that have been used to meet the guidance precision requirements. The majority of the present approaches are based on terminal homing seekers. The problem with these approaches is the high costs associated with seeker components such as gimbals, domes, high performance electronics and software. Other techniques make use of a human in the loop to reduce the complexity and costs of the components installed aboard a missile. In these techniques, a human operator provides assistance to a missile's guidance system by correcting its trajectory through a data link such that a satisfactory trajectory of the missile to the target is achieved. This approach substantially reduces the costs of the guidance system but the precision is directly proportional to the operator's skill and this can be highly variable.

Many of the present guidance techniques share a common weakness in that they are susceptible to detection and countermeasures (CM) being applied by a target since the field-of-view (FOV) of their guidance sensor have to continuously look at the target. Countermeasures that may be employed include dazzling or destruction of the sensor, which would ruin guidance of the missile. Moreover, the majority of guidance systems for missiles still rely on complex and costly gyroscopes and accelerometers to assist in guidance.

One technique using an operator to guide missiles during flight is described in U.S. Pat. No. 4,234,141 by Walter E. Miller Jr. which issued on 18 Nov. 1980. In this guidance system, an observer establishes and maintains a visual line-of-sight contact with a target through a telescope. In tracking the missile's trajectory towards the target, short pulses of collimated light are transmitted from the launch site towards the missile, which pulses are received by an optical receiver on the missile and are simultaneously reflected by a retro reflective prism on the missile. The reflected pulses follow a path parallel to the incident wave and are thus directed back to the launch site. A missile tracker at the launch site responds to the reflected pulses and measures any deviation of the missile from the visual line-of-sight maintained between the launch site and the target. Guidance commands are then transmitted towards the missile for maintaining the missile on a proper trajectory, which pulses contain correctional signals for the missile's guidance system. The guidance precision of this technique is proportional to the observer's (operator's) skill in maintaining the visual line-of-sight contact with the target and this can be rather variable.

Another missile guidance system is a scatterider guidance system that utilizes a designating beam of laser pulses directed from the launch pad towards a target. Atmospheric particles scatter the laser pulses and sensors on the missile detect the laser light scattered by the atmospheric particles and onboard guidance electronics calculate the radial distance between the laser beam and the longitudinal axis of the missile. That distance is then used to generate deflection commands for the aerodynamic control surfaces of the missile such that it stays close to the laser beam. In the embodiment described by McCowan et al in U.S. Pat. No. 6,138,944, laser light scattered from atmospheric particles for one laser pulse is detected by eight aft-looking optical sensors mounted around the circumference of the missile and one annular forward-looking sensor mounted on the nose section. The aft-looking sensors are mounted with their centrelines angled such that they point 60 degrees aft of the perpendicular to the missiles' longitudinal axis and each has a field-of-view of 45 degrees so the eight sensors provide a 360 degree coverage around the missile. The detection of back-scatter laser light is provided by one annular forward-looking sensor that is mounted such that it stares at a 45 degree angle forward of the perpendicular to the missile's longitudinal axis.

In U.S. Pat. No. 6,138,944, when light scattered from a single laser pulse is detected by one of the eight aft-looking sensor and by the forward-looking sensor, this detection as well as the time lapse between the detection by the aft-looking sensor and detection by the forward-looking sensor are provided as inputs to guidance electronics. That time lapse will be directly dependent on the radial distance between the missile's longitudinal axis and the laser beam due to the time it takes the laser pulse to travel from the aft-looking detection point and the forward-looking detection point. The guidance electronics is coupled to the aft-looking sensors to derive which one actually detected the scattered light and then calculates the radial distance between the laser beam and the missile using principles of geometry and trigonometry. That distance as well as the aft-looking detector that detected the scattered laser light is used to generate commands for the guidance system to maintain the missile on the desired trajectory with respect to the laser beam. The precision of this guidance system is dependent on the precision of the geometric and trigonometry calculations. The annular forward-looking sensor will limit what type of countermeasure may be effective since no sensor is looking directly at the target. It does, however, require inertial rate sensors and a roll sensor.

Another laser guidance system for a missile is described in JP Patent No. 2000039296 (Application No. JP 98209942) based on three laser beams directed along vertices of an equilateral triangle between which a missile flies and determines its position by the relative level of scattered laser light detected by a number of sensors on the missile.

A further laser guidance system for a missile is described by Walter E. Miller Jr., in US Statutory Invention Registration H299 that was published on 7 Jul. 1987. In this system the operator maintains sight of a target through optics at a fire control station. A laser transmitter on the missile directs a laser beam towards the fire control station where it is received and coupled to a phase conjugated amplifier and redirected back through a spatial encoder to the missile. The encoding provides guidance instructions for the missile where the redirected beam is received and applied to the missile's guidance control system. This guidance system does not have any sensor directed toward the target and this limits what type of countermeasures may be effective. It does, however, require an operator in the loop that has to maintain visual sight of the target.

The majority of guidance techniques, other than those taught by McCowan et al and Walter E. Miller Jr., share a common weakness in that they are susceptible to detection by the target which can employ countermeasure since the field-of-view of their guidance sensor have to continuously look at the target. Countermeasure that may be employed include dazzling or destruction of the sensor which would ruin the precision guidance of the missile. The majority of these missiles guidance systems still rely on complex and costly gyroscopes and accelerometers to assist in guidance.

A new generation of hypervelocity missiles presently being developed inevitably call for a highly profiled fuselage nose that denies any possibility of using a forward-looking sensor because that would require a dome at the tip of the missile. There is, as a result, a requirement for a new guidance system for missiles that would be almost immune to known countermeasures while permitting use of a highly profiled nose and provide for a low cost implementation.

The basic Beam Laser Atmospheric Scattering Trajector (BLAST) guidance system according to the present invention is illustrated in FIG. 1. That system, according to a first embodiment of the present invention consists of a laser source 1, a beam encoder 2 and a series of laser sensors 3 mounted on a side of the main body of the missile 10 (only one sensor is necessary but two or more improve the refreshing rate and accuracy). Laser source 1 and beam encoder 2 form the guidance source that are part of the missile launch pad.

Each sensor 3 has a photodetector 4, a lens 5 to focus light scattered from laser beam 8 directed to target 9 onto photodetector 4 and an optical filter 6 in the optical path to the photodetector to block light from sources other than that scattered from laser beam 8 from reaching photodetector 4. Signal from the sensors 3 are supplied to processing electronics 7 located inside the missile 10 that analysis signal outputs from the laser sensors 3 to determine the distance the missile 10 is from beam 8 and then generate the necessary trajectory corrections to the guidance system (not shown) for the missile 10. The laser sensors 3 and processing electronics 7 represent the guidance sensor device and are located on and aboard the missile 10.

The laser beam 8 directed to target 9 may be either continuous wave (CW) or temporally and/or spatially modulated by the beam encoder 2 to bear information that will be used by the missile 10 for its guidance. The guidance schemes are numerous and could include either temporal modulation such as sinusoidal or square wave modulation or a complex series of pulses. Spatially encoder multi-element beams may also be used or combinations of both. In a basic embodiment, a simple CW beam 8 can be used which is projected in the direction of target 9 and which is switched on prior to or simultaneously with the launch of missile 10. The laser beam 8 (or beams 8 and 8, in FIG. 4) are scattered by particles and molecules naturally present in the atmosphere. The laser sensors 3 mounted on the side of the main body of missile 10 look sideways to the axis of missile 10 as illustrated by 20 in FIG. 2A and backwards since there is more signal to be detected from the forward scattering of the laser beam 8 in those directions. Each laser sensor 3 comprise a photodetector 4, an optical filter 6 to minimize the level of background signal (mainly from the sun) and a lens 5 that defines a field of view (FOV) 20 of a few tens of degree sideways and backwards to the longitudinal axis of the missile and a relatively narrow FOV in the forward direction as illustrated by 20 in FIG. 2.

Since the missile 10 is spinning, each laser sensor's 3 FOV will intercept scattered radiation from the laser beam 8 having a known diameter once per revolution and generate an output signal pulse with a pulse-width that is proportional to the distance between the laser beam 8 and the missile 10 as illustrated in FIGS. 2B and 2C. The effective width of the laser beam 8 and scattered radiation as detected by a sensor 3 will be smaller the further the missile 10 is from laser beam 8 than that effective width as detected by a sensor 3 when the laser beam 8 is closer to the missile 8 due to that width appearing smaller with increasing distance between the beam 8 and missile 10. This is illustrated in FIGS. 2B and 2C where FIG. 2B shows a signal 12 generated by a sensor 3 when that sensor is closer to the laser beam 8 (a wider signal pulse) than when the sensor 3 is further away from beam 8 where that sensor will generate a narrower signal pulse 14 (see FIG. 2C) as it detects radiation scattered by beam 8. Thus, the distance between the missile 10 and laser beam 8 can be determined by the width of the pulse generated by a sensor 3 as it detects radiation scattered from beam 8. This pulse-width measurement technique can be used when a CW or near CW laser source is used as illustrated in FIG. 2.

When a pulsed laser source is used, as illustrated by pulses $\mathbf{8}_1$, $\mathbf{8}_2$, $\mathbf{8}_3$ . . . $\mathbf{8}_n$ in FIG. 3A, the laser sensor(s) 3 will detect a series of pulses (one burst of pulses per missile turn) instead of a single pulse with a variable pulse width as illustrated in FIGS. 2B and 2C. The signals 16 generated by a sensor 3 when detecting radiation scattered by pulses $\mathbf{8}_1$, $\mathbf{8}_2$, . . . $\mathbf{8}_n$ in a laser beam are illustrated in FIG. 3B and FIG. 3C. The closer the missile 10 is to the laser beam, the larger the number of pulses will be generated as illustrated in FIG. 3B. When the sensor 3 on missile 10 is further away from the laser beam, a fewer number of pulses 16 will be generated by sensor 3 as illustrated in FIG. 3C. This pulse measuring technique dramatically simplifies the signal-processing requirements for the guidance system since the distance measurement becomes only a pulse counting process by a counter. With both of these techniques, the missile's 10 can also measure its roll rate by measuring the rate of the pulses in the case of the CW laser source and the rate of occurrence of the generated pulse bursts in the case of a pulsed laser source.

Figure 4:
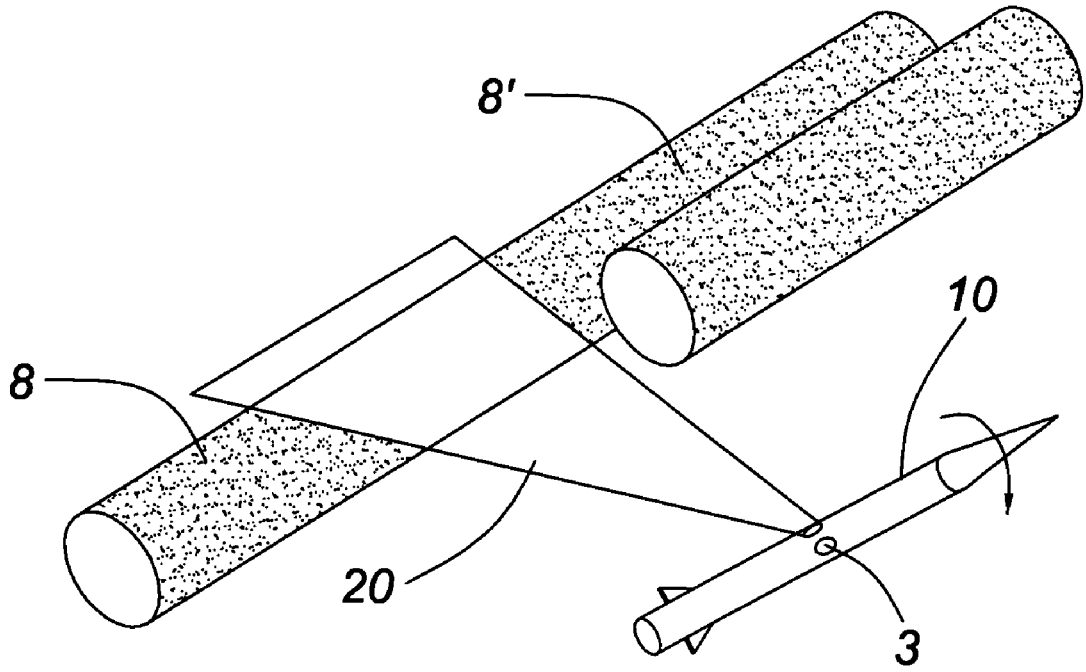
FIG. 4 illustrates the operation of a laser beam guidance system for a spinning missile according to a further embodiment of the present invention.
Figure 5A:
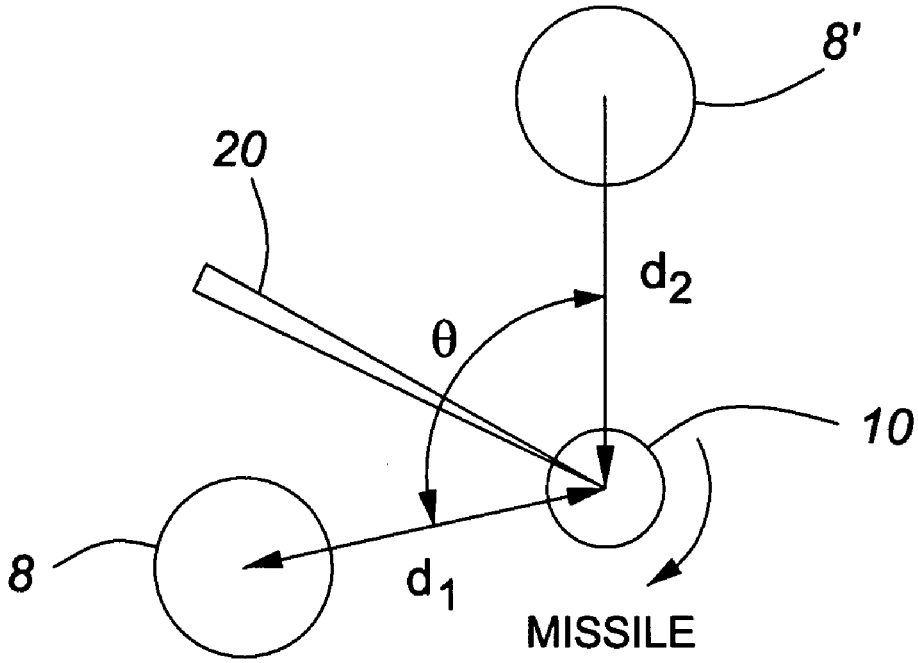
FIG. 5A diametrically illustrates the principle of operation of FIG. 4 with FIG. 5*b* showing the type of signals obtained by a sensor in FIG. 4.
Figure 5B:
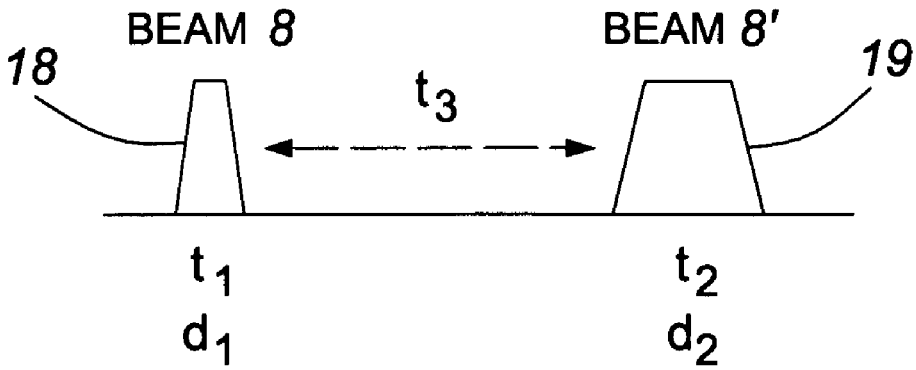

One laser sensor 3 on a missile 10 would be sufficient but adding more sensors 3 on the missile 10 will increase the refresh rate of the distance measurement. One laser beam is sufficient for basic distance measurement of a missile 10 from that beam. By adding more laser beams, however, more position information of the missile relatively to the beams can be obtained. This more advanced embodiment of the BLAST guidance technique where two CW laser beams 8 and 8' are used is illustrated in FIG. 4. The same principle would be similar for pulsed laser beams. It, then, becomes possible to also measure the relative missile distances from the two laser beams 8 and 8', i.e. the position d2 in the vertical direction and d1 in the horizontal direction as illustrated in FIG. 5A. FIG. 5B shows the type of signals 18 and 19 generated by one sensor 3 in FIG. 4 during one rotation of the spinning missile 10. In this case, by measuring the delay $t_3$ between detecting pulse 18 at the time $t_1$ and the pulse 19 at time $t_2$ (one pulse for a CW laser or two bursts of pulses for pulsed laser beams) per missile turn, it becomes possible to measure an angle θ where θ is proportional to the delay $t_3$. The two laser beams can be modulated by an encoder in a different manner so that one can be differentiated from the other by the processing electronics or have different widths to differentiate one from the other, the first detected beam having a known diameter and the second detected beam having a known diameter.

The measured angle θ is used to remove the uncertainty as to if the missile is above or below the beam pair. There are always two physical positions (one above and one below) for which the values of the two positions d1 and d2 are the same. If the angle θ is not measured, then the missile will require an attitude sensor onboard to continuously determine its roll position and remove any uncertainty.

Various modifications may be made to the preferred embodiments without departing from the spirit and scope of the invention as defined in the appended claims. The same type of guidance system could, for instance, be used for remote guidance of vehicles other than missiles.

The embodiment of the invention in which an exclusive property or privilege is contained is claimed are defined as follows:

1. A guidance system for a vehicle comprising a laser source directing at least one laser beam towards a required designated final location for the vehicle on which at least one sensor is located, that sensor rotating around an axis in a direction of travel of the vehicle and having a field-of-view (FOV) that is generally directed sideways to the direction of travel of the vehicle, the sensor generating a pulse signal in response to detecting radiation from the laser beam scattered by an atmosphere through which the laser beam propagates, the pulse signal having a number of pulses proportional to the distance between the beam and said vehicle, signals from said at least one sensor being applied to a vehicle guidance system in the vehicle having processing electronics that determines the distance from the vehicle to the beam and then provides correction commands to the guidance system to correct the vehicle's direction of travel.

2. A guidance system for a vehicle according to claim 1, wherein each sensor comprises a lens to focus radiation scattered from said at least one laser beam onto a photodetector, a filter being located in an optical path to the photodetector to minimize background radiation from reaching that photodetector.

3. A guidance system for a vehicle according to claim 2, wherein a plurality of said sensors are located on the vehicle, each rotating around an axis in a direction of travel of the vehicle.

4. A guidance system for a vehicle as defined in claim 3, wherein an encoder is located at said laser source in a position to modulate said laser beam.

5. A guidance system for a vehicle as defined in claim 3, wherein an encoder is located at said laser source to provide a pulsed laser beam.

6. A guidance system for a vehicle as defined in claim 2, wherein an encoder is located at said laser source in a position to modulate said laser beam.

7. A guidance system for a vehicle as defined in claim 2, wherein an encoder is located at said laser source to provide a pulsed laser beam.

8. A guidance system for a missile comprising a laser source at a launch pad for the missile directing at least one laser beam towards a target for the missile, the missile rotating about its longitudinal axis as it travels towards its target, at least one sensor located on the missile such that it has a field of view (FOV) that is generally directed sideways to the direction of travel of the missile and partially backward to that direction of travel, said at least one sensor generating a pulse signal in response to detecting radiation scattered from said at least one laser beam by an atmosphere through which that laser beam propagates, the pulse signal having a number of pulses proportional to the distance between the missile and said at least one laser beam, signals from said at least one sensor being applied to a missile's guidance system in the missile having processing electronics that determines the distance between the missile and said at least one beam from said pulse signal and which, from said distance, generates commands for the guidance system to correct the missile's trajectory towards said target.

9. A guidance system for a missile according to claim 8, wherein each sensor comprises a lens to focus radiation scattered from said at least one laser beam onto a photodetector, a filter being located in an optical path to said photodetector to minimize background radiation from reaching that photodetector.

10. A guidance system for a missile according to claim 9, wherein a plurality of said sensors are located on a surface of said missile between its nose and its propulsion system.

11. A guidance system for a missile as defined in claim 9, wherein an encoder is located at said laser source to provide a pulsed laser beam.

12. A guidance system for a missile as defined in claim 11, wherein the number of pulses of said signal is determined by a counter counting pulses generated by said at least one sensor in a burst of pulses from that sensor when said at least one sensor detects radiation scattered from said pulsed laser beam.

13. A guidance system for a missile according to claim 8, wherein a plurality of said sensors are located on a surface of said missile between its nose and its propulsion system.

14. A guidance system for a missile as defined in claim 8, wherein an encoder is located at said laser source in a position to modulate said laser beam.

15. A guidance system for a missile as defined in claim 8, wherein the laser source generates at least two spaced apart parallel laser beams.

16. A guidance system for a missile as defined in claim 15, wherein an encoder is located at said laser source to modulate at least one of said laser beams.

17. A guidance system for a missile as defined in claim 15, wherein an encoder is located at said laser source to provide a pulsed laser beam.

18. A guidance system for a missile as defined in claim 17, wherein the number of pulses of said signal is determined by a counter counting pulses generated by said at least one sensor in a burst of pulses from that sensor when said at least one sensor detects radiation scattered from said pulsed laser beam.

19. A guidance system for a missile as defined in claim 8, wherein said laser source generates two parallel laser beams towards a target for the missile, each laser beam being modulated in a different manner by an encoder to enable the processing electronics to differentiate between the beams, said at least one sensor detecting radiation scattered from the beams and providing pulse signals to the processing electronics to determine a distance to each beam based on the number of pulses of the signals generated by said at least one sensor, the angle between each measured distance being determined by the processing electronics from a time measured between when said at least one sensor last detects radiation scattered from one beam and a time measured when that sensor first detects radiation scattered from a second beam.

20. A guidance system for a missile according to claim 8, wherein said laser source generates two parallel laser beams towards a target for said missile, the laser beams having different diameters to enable the processing electronics to differentiate between the beams, said at least one sensor detecting radiation scattered from the beams and providing pulse signals to the processing electronics to determine the distance to each beam from the number of pulses of the pulse signals generated by said at least one sensor, the angle between each measured distance being determined by the processing electronics from a time measured when said at least one sensor last detects radiation from a first detected beam and a time measured when that sensor first detects radiation scattered from a second beam.

21. A guidance system for a missile comprising a laser source at a launch pad for the missile directing at least one laser beam towards a target for the missile, the missile rotating about its longitudinal axis as it travels towards its target, at least one sensor located on the missile such that it has a field of view (FOV) that is generally directed sideways to the direction of travel of the missile and partially backward to that direction of travel, said at least one sensor generating a pulse signal in response to detecting radiation scattered from said at least one laser beam by an atmosphere through which that laser beam propagates, the pulse signal having a pulse width proportional to the distance between the missile and said at least one laser beam, signals from said at least one sensor being applied to a missile's guidance system in the missile having processing electronics that determines the distance between the missile and said at least one beam from said pulse signal and which, from said distance, generates commands for the guidance system to correct the missile's trajectory towards said target.

22. A guidance system for a missile according to claim 21, wherein a plurality of said sensors are located on a surface of said missile between its nose and its propulsion system.

23. A guidance system for a missile as defined in claim 21, wherein the laser source generates at least two spaced apart parallel laser beams and an encoder is located at said laser source to modulate at least one of said laser beams.

24. A guidance system for a missile as defined in claim 21, wherein said laser source generates two parallel laser beams towards a target for the missile, each laser beam being modulated in a different manner by an encoder to enable the processing electronics to differentiate between the beams, said at least one sensor detecting radiation scattered from the beams and providing pulse signals to the processing electronics to determine a distance to each beam based on the pulse width of the signals generated by said at least one sensor, the angle between each measured distance being determined by the processing electronics from a time measured between when said at least one sensor last detects radiation scattered from one beam and a time measured when that sensor first detects radiation scattered from a second beam.

25. A guidance system for a missile according to claim 21, wherein said laser source generates two parallel laser beams towards a target for said missile, the laser beams having different diameters to enable the processing electronics to differentiate between the beams, said at least one sensor detecting radiation scattered from the beams and providing pulse signals to the processing electronics to determine the distance to each beam from the pulse width of the pulse signals generated by said at least one sensor, the angle between each measured distance being determined by the processing electronics from a time measured when said at least one sensor last detects radiation from a first detected beam and a time measured when that sensor first detects radiation scattered from a second beam.

* * * * *